US008872718B2

(12) United States Patent
Desagulier

(10) Patent No.: US 8,872,718 B2
(45) Date of Patent: Oct. 28, 2014

(54) RADIO ANTENNA

(75) Inventor: Christian Desagulier, Paris (FR)

(73) Assignee: Astrium SAS, Paris (FR)

( * ) Notice: Subject to any disclaimer, the term of this patent is extended or adjusted under 35 U.S.C. 154(b) by 74 days.

(21) Appl. No.: 13/260,602

(22) PCT Filed: Apr. 2, 2010

(86) PCT No.: PCT/EP2010/054455

§ 371 (c)(1),
(2), (4) Date: Sep. 27, 2011

(87) PCT Pub. No.: WO2010/112599

PCT Pub. Date: Oct. 7, 2010

(65) Prior Publication Data

US 2012/0026055 A1 Feb. 2, 2012

(30) Foreign Application Priority Data

Apr. 2, 2009 (FR) ..... 09 52149

(51) Int. Cl.
*H01Q 19/10* (2006.01)
*H01Q 15/16* (2006.01)
*H01Q 1/00* (2006.01)

(52) U.S. Cl.
CPC ..... *H01Q 1/005* (2013.01); *H01Q 15/16* (2013.01)
USPC ..... 343/834

(58) Field of Classification Search
USPC ..... 343/834, 878, 892, 912; 174/138 A, 174/153 A, 158 R
See application file for complete search history.

(56) References Cited

U.S. PATENT DOCUMENTS

| | | | | | |
|---|---|---|---|---|---|
| 3,230,185 | A | * | 1/1966 | Kopnick et al. | 521/112 |
| 3,620,987 | A | * | 11/1971 | McLaughlin et al. | 521/114 |
| 3,897,294 | A | * | 7/1975 | MacTurk | 156/245 |
| 4,636,801 | A | * | 1/1987 | Myer | 343/781 CA |
| 5,178,709 | A | * | 1/1993 | Shimodaira et al. | 156/242 |
| 5,184,141 | A | | 2/1993 | Connolly et al. | |
| 5,900,442 | A | * | 5/1999 | Leenslag et al. | 521/174 |
| 2004/0113863 | A1 | | 6/2004 | Stonier | |

FOREIGN PATENT DOCUMENTS

EP 1 589 612 A1 10/2005

OTHER PUBLICATIONS

The ARRL Antenna Book, 1988, the American Radio Relay League, 15th edition, 2-24 and 2-25.*
International Search Report for PCT/EP2010/054455 dated May 26, 2010.
French Preliminary Search Report for FR 0952149 dated Sep. 24, 2009.

* cited by examiner

*Primary Examiner* — Hoang V Nguyen
*Assistant Examiner* — Patrick Holecek
(74) *Attorney, Agent, or Firm* — Pearne & Gordon LLP

(57) ABSTRACT

The invention concerns a radio antenna for a space satellite, including a reflector and means of support of this reflector. The reflector includes a front skin able to reflect radio waves, a rigid rear structure supported by the means of support, and a layer of elastic material interposed between said front skin and said rigid rear structure, able to dampen the vibrations of the front skin.

15 Claims, 1 Drawing Sheet

RADIO ANTENNA

TECHNICAL FIELD

The present invention relates to the field of reflector radio antennae, and concerns in particular an antenna for a spacecraft, such as a telecommunications satellite.

STATE OF THE PRIOR ART

The antennae of spacecrafts must satisfy specifications notably concerning the reflectivity of their reflectors, but also the mechanical properties of the fastenings of the reflectors to the spacecrafts, which are subject to the vibratory, acoustic and dynamic stresses caused by space launchers. These antennae must also satisfy specifications concerning their thermoelastic properties in orbit.

Since the level of acoustic stresses caused by the launchers is very difficult to predict, it is preferable that these antennae should be almost insensitive to acoustic efforts, in order to limit the risks of under-dimensioning or over-dimensioning of the reflectors' fastenings to the spacecrafts.

Figure 1:
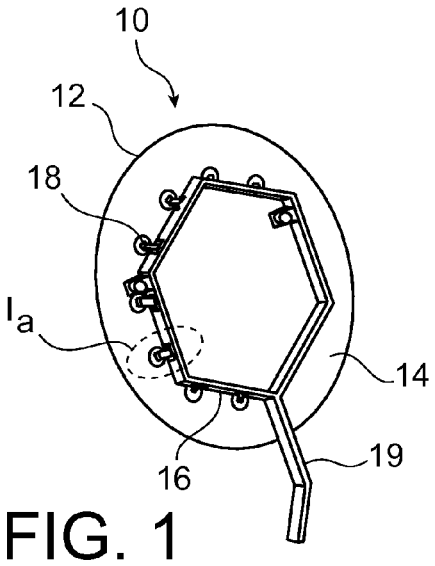
Figure 1A:
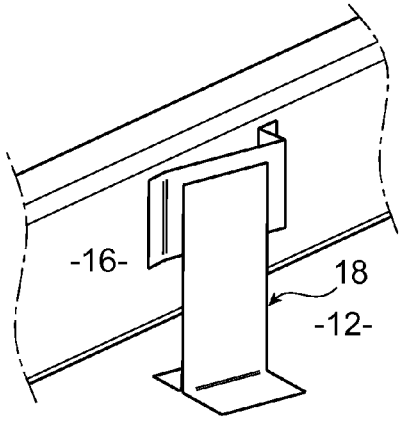

FIGS. 1 and 1*a* represent an example of a radio antenna 10 (FIG. 1) for a telecommunications satellite operating at frequencies of between 12 GHz and 18 GHz approximately (Ku band), of a known type.

Reflector 12 of antenna 10 includes a body 14 of the sandwich type formed from a honeycomb structure on to which are affixed a front skin—commonly called the active skin—and a rear skin, where each of said skins consists of a sheet of carbon fibres sunk in an epoxy resin.

Body 14 of reflector 12 is supported by a rigid tubular rear structure 16 of the reflector. This rear structure 16 is, for example, hexagonal in shape, centred on an axis of the reflector, and smaller in size than the reflector.

Rear structure 16 is connected to the rear skin of body 14 by angles 18 (FIG. 1*a*) capable of providing the mechanical properties of the antenna at launch and insertion into orbit of the satellite fitted with said antenna, and also a thermomechanical decoupling between reflector 12 and rear structure 16 when the satellite is in orbit. In addition, rear structure 16 is supported by a support arm 19 intended to provide the connection between antenna 10 and the satellite.

The carbon fibres of the sheets of the abovementioned front and rear skins are positioned in the form of triaxial fabrics which are characterised by near-isotropic mechanical properties, and by the presence of through-perforations which are regularly distributed over their surface.

These perforations allow the mass of the reflector to be reduced, and communicate with cells in the honeycomb structure, such that this type of reflector is insensitive to vibratory stresses, particularly to acoustic stresses at the launch of the satellite fitted with antenna 10.

The composite materials used in these antennae generally make them very light, which constitutes an essential advantage in the field of space applications.

However, the reflectivity properties of the perforated reflectors of the type described above are not satisfactory at frequencies of approximately between 20 GHz and 40 GHz (Ka band).

Solutions have been proposed, which consist, using an antenna of the type described above, in reducing the dimensions of the perforations of the active skin, or even in replacing the perforated active skin by an unperforated skin, but the antennae obtained in this manner have proved to be too sensitive to acoustic stresses.

Moreover, at these higher frequencies, the tolerances relative to the profiles of the reflectors are stricter, leading to more severe requirements in terms of manufacturing precision, and of stability over time of the reflectors, typically of the order of 30 μm RMS, which should be compared with 150 μm RMS in the case of satellites operating at the lower frequencies of the Ku band.

And the sandwich structures of the type described above, which include skins formed from a single sheet of composite material, do not easily allow the criteria inherent to operation in the Ka band to be satisfied.

SUMMARY OF THE INVENTION

One aim of the invention is notably to provide a simple, economic and efficient solution to these problems, allowing the abovementioned disadvantages to be avoided.

Its goal is notably a radio antenna for space satellite, capable of operating at the frequencies of the Ka band, and satisfying the requirements imposed on this type of antenna, notably in respect of the sensitivity of the antenna to the vibratory stresses caused by the launchers, the precision of manufacture of the profile of the antenna's reflector and the stability of this profile over time and, generally, the antenna's thermomechanical properties in orbit.

The invention proposes to this end a radio antenna, particularly for a spacecraft, including a reflector and means of support of this reflector, where the reflector includes a front skin able to reflect radio waves, and a rigid rear structure supported by the means of support, where the reflector includes a layer of elastic material which is interposed between the front skin and the rigid rear structure, and which is able to dampen the vibrations of the front skin.

The layer of elastic material enables the impact of vibratory stresses, notably acoustic stresses, on the means of support of the antenna's reflector to be reduced substantially.

This enables the level of mechanical properties required for the means of support to be limited, thus making the dimensioning of these means support easier.

In a preferred embodiment of the invention, the reflector's front skin is a solid skin, i.e. one which is not perforated.

The presence of the layer of elastic material indeed makes possible the use of a solid front skin, capable of giving the reflector optimal properties of reflectivity, whilst limiting the risks of under-dimensioning of the reflector's means of support.

In the preferred embodiment of the invention the said elastic material has a Young's modulus of between 0.25 MPa and 1 MPa, a traction resistance of between 0.1 MPa and 0.5 MPa, and a breaking elongation of between 20% and 40%.

The layer of elastic material is thus capable of dampening optimally the vibratory stresses to which the antenna is likely to be subject, particularly when the antenna is fitted to a spacecraft.

In the preferred embodiment of the invention, said elastic material is a foam, and includes at least one compound belonging to the group of polyimides.

In addition, this elastic material preferably has a density of between 10 kg/m$^3$ and 20 kg/m$^3$.

The use of an elastic material of this type allows a weight gain compared to the antennae of the prior art, the honeycomb structure of which generally has a density of between 26 kg/m$^3$ and 34 kg/m$^3$.

This weight gain may be turned to good account to increase the thickness of the front skin, so as to improve the precision and the stability over time of the profile of this front skin, without making the antenna appreciably heavier compared to antennae of known types. As will appear more clearly below, this weight gain also enables the reflector's rigid rear structure to be strengthened.

As a variant, the elastic material may include at least one elastomer adhesive.

When the antenna is fitted to a spacecraft, the elastic material is chosen so as not to deteriorate at space operational temperatures in orbit, and more specifically at temperatures of between −180° C. and +200° C.

In the preferred embodiment of the invention the rigid rear structure includes a rear structural skin connected securely to the reflector's said means of support.

The dampening properties of the layer of elastic material are, indeed, sufficient to enable such a rear skin to fulfil the structuring function of the rigid tubular rear structures of the antennae of the prior art of the type described above.

The rear structural skin preferably includes at least one part of increased thickness, to which the said means of support of the reflector are connected.

Such a part of increased thickness enables the connection between the reflector and the means of support of the latter to be strengthened.

In the preferred embodiment of the invention, the front skin and the rear structural skin are made from a composite material including fibres sunk in a hardened resin.

These fibres are advantageously carbon fibres positioned so as to optimise the isotropy of the mechanical and thermal properties of these skins.

To accomplish this said fibres can, for example, be positioned in the form of two sheets of taffeta fabrics intersecting at angles of more or less 45 degrees, or in the form of three to six sheets of layers of fibres draped symmetrically (0°, +60°, −60°).

These manners of positioning of the fibres also allow the precision and the stability of the profiles of the skins to be improved compared to the skins with a single sheet of conventional reflectors.

The layer of elastic material is preferably attached to the front skin and to the rear skin by gluing.

This gluing may be accomplished simply by uniform contact and under adequate initial pressure, of the front and rear faces of the layer of foam respectively with the front skin and the structural rear skin.

In the preferred embodiment of the invention the rear structural skin is flat and extends perpendicularly to an axis of the reflector.

The layer of elastic material is then advantageously profiled such that its front and rear faces have roughly the same shape respectively as the front skin and the rear skin.

As a variant, the shape of the rear structural skin is roughly identical to that of the front skin.

In all cases, the layer of elastic material is profiled to maximise the area of contact between its upper face and the front skin, firstly, and between its lower face and the rear skin, secondly. As a consequence of its elasticity, the layer of elastic material also enables the discrepancies between the theoretical and real profiles of the front and rear skins to be compensated, and also enables the presence of any parts of increased thickness of the rear structural skin to be compensated.

The gluing area between the front and rear skins, respectively, and the layer of elastic material can thus be maximal, so as notably to allow a reduction of the requirements relative to the mechanical shearing properties of the reflector's means of support.

Advantageously, the rear structural skin includes a hollowed central part.

When the layer of elastic material is sufficiently dense this characteristic allows a mass gain.

In the preferred embodiment of the invention the rear structural skin includes, all in one piece, fastenings to the means of support.

These means of support, which are for example formed of an arm, can indeed be connected to the rear structural skin by sinking a part of attachment of these means of support in the resin that is part of the rear structural skin.

This provides optimum connection between the reflector and the means of support of this reflector.

Generally, the antenna is advantageously configured to operate in a predetermined band of frequencies of the microwave spectrum, where this band of frequencies can in particular be within the Ka band.

The use of an unperforated active face, made possible by the invention, is indeed particularly advantageous in the Ka band, as was explained above.

BRIEF DESCRIPTION OF THE ILLUSTRATIONS

Figure 2:
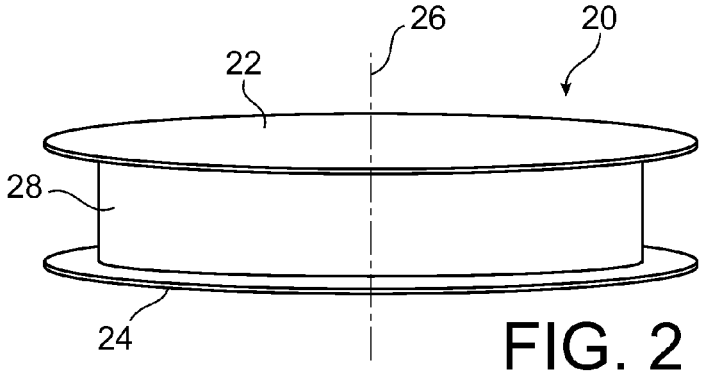

The invention will be better understood, and other details, advantages and characteristics of it will appear, on reading the following description given as a non-restrictive example, and with reference to the appended illustrations, in which:

FIG. 1, which has already been described, is a schematic perspective view of a radio antenna of a known type;

FIG. 1*a*, which has already been described, is a larger-scale view of detail 1*a* of FIG. 1;

FIG. 2 is a schematic perspective view of the reflector of a radio antenna according to the invention.

DETAILED DESCRIPTION OF A PREFERRED EMBODIMENT

FIG. 2 represents a reflector 20 of a radio antenna for a spacecraft according to a preferred embodiment of the invention.

Reflector 20 includes a front skin 22, sometimes also called the active skin, and a rear structural skin 24 supported by a support arm (not represented in FIG. 2), intended to provide the connection between the antenna and a spacecraft.

In the represented embodiment the shape of front skin 22 of the reflector is roughly that of a paraboloid of revolution around an axis 26.

This front skin 22 is made from a conventional composite material, of the type including a fabric of structural fibres, for example carbon, sunk in an epoxy or comparable resin. The structural fibres are woven according to a drape-forming capable of providing an optimal isotropy of the mechanical properties of front skin 22, and such that front skin is solid. To accomplish this the structural fibres are, for example, positioned in the form of two sheets of taffeta fabrics intersecting at angles of 45 degrees, or in the form of three to six sheets of layers of fibres draped symmetrically (0°, +60°, −60°). This type of structure notably enables the precision and the stability over time of the profile of the front skin to be optimised.

Rear skin 24 is made from a composite material comparable to that of front skin 22, but has a more rigid structure than that of the front skin, in order to be able to provide the mechanical connection between the front skin of the reflector and the antenna's support arm. Rear skin 24 thus constitutes a rigid rear structure.

The support arm includes an end attached by gluing to the rear face of rear skin 24.

As a variant, the end of the support arm can be incorporated in rear skin 24, for example by sinking said end in the resin comprising rear skin 24.

Structural rear skin 24 includes one or more strengthened parts of increased thickness located at the area of the attachment of the antenna's support arm.

Front skin 22 and rear structural skin 24 are glued respectively on to the front and rear faces of a polyimide foam layer 28, intended to dampen the vibrations to which front skin 22 is likely to be subject, notably during the launch and insertion into orbit of a spacecraft fitted with the antenna.

The polyimide foam is chosen such that it does not deteriorate at temperatures of between −180° C. and +200° C., and in order to satisfy the space standards relative to degassing, typically specifying a total mass loss (TML) of less than 1% approximately.

This foam is also chosen to have thermomechanical properties such that this foam affects the thermomechanical properties of reflector 20 as little as possible. In particular, the foam is chosen to have the lowest possible thermoelastic coefficient.

In addition, the polyimide foam has a density of between 10 kg/m$^3$ and 20 kg/m$^3$, a traction resistance of between 0.1 MPa and 0.5 MPa, a Young's modulus of between 0.25 MPa and 1 MPa, and a breaking elongation of between 20% and 40%. The abovementioned physical parameters are chosen in accordance with the level of dampening and mechanical decoupling required between front skin 22 and structural rear skin 24.

In the represented embodiment the shape of structural rear skin 24 is that of a flat disk, and foam layer 28 is profiled such that it maximises the contact surface firstly between the front face of foam layer 28 and front skin 22, and secondly between the rear face of foam layer 28 and rear skin 24.

As a variant, the shape of rear skin 24 may be similar to that of front skin 22.

In all cases foam layer 28 allows the discrepancies between the theoretical and real profiles of front skin 22 and rear skin 24 to be compensated, and also allows the part or parts of increased thickness of rear skin 24 to be compensated.

As another variant, if foam layer 28 is sufficiently dense, structural rear skin 24 can include a hollowed central part, so as to form a crown centred on axis 26 of the reflector.

The shape of the front skin of the reflector can, of course, be different from the one described above as an example, without going beyond the scope of the invention.

The invention claimed is:

1. A radio antenna, particularly for a spacecraft, including a reflector and means of support of this reflector, where the reflector includes a front skin able to reflect radio waves, and a rigid rear structure supported by the means of support, wherein said reflector includes a layer of elastic material which is interposed between said front skin and said rigid rear structure, and which is able to dampen the vibrations of the front skin, said elastic material comprising a fraction resistance of between 0.1 MPa and 0.5 MPa, a breakage elongation of between 20% and 40%, and a density of between 10 kg/m$^3$ and 20 kg/m$^3$, the elastic material being a foam.

2. An antenna according to claim 1, wherein said front skin is a solid skin.

3. An antenna according to claim 1, wherein said elastic material has a Young's modulus of between 0.25 MPa and 1 MPa.

4. An antenna according to claim 1, wherein said elastic material has a Young's modulus of between 0.25 MPa and 1 MPa.

5. An antenna according to claim 1, wherein said elastic material is one or more elastomer adhesives.

6. An antenna according to claim 1, wherein said rigid rear structure includes a rear structural skin connected to the means of support of the reflector.

7. An antenna according to claim 6, wherein the rear structural skin is flat and extends perpendicularly to an axis of the reflector.

8. An antenna according to claim 6, wherein the shape of the rear structural skin is roughly identical to that of the front skin.

9. An antenna according to claim 6, wherein said rear structural skin includes a hollowed central part.

10. An antenna according to claim 6, wherein said rear structural skin includes, in a single piece, fastenings to the means of support.

11. An antenna according to claim 1, configured to operate in a predetermined frequency band of the microwave spectrum, within the Ka band.

12. A radio antenna for a spacecraft, comprising:

a reflector comprising a front skin, a rigid rear structure, and a layer of elastic material, the front skin being configured to reflect radio waves, the layer of elastic material being interposed between the front skin and the rigid rear structure and configured to dampen vibrations of the front skin, the layer of elastic material being directly contacted by the front skin; and means of support of the reflector, the means of support being configured to support the rigid rear structure.

13. An antenna according to claim 12, wherein the elastic material comprises a traction resistance of between 0.1 MPa and 0.5 MPa, a breakage elongation of between 20% and 40%, and a density of between 10 kg/m$^3$ and 20 kg/m$^3$.

14. A radio antenna for a spacecraft, comprising:

a reflector comprising a front skin, a rigid rear structure, and a layer of elastic material consisting of polyimide foam, the front skin being configured to reflect radio waves, the layer of elastic material being interposed between the front skin and the rigid rear structure and configured to dampen vibrations of the front skin; and means of support of the reflector, the means of support being configured to support the rigid rear structure.

15. An antenna according to claim 14, wherein the elastic material comprises a traction resistance of between 0.1 MPa and 0.5 MPa, a breakage elongation of between 20% and 40%, and a density of between 10 kg/m$^3$ and 20 kg/m$^3$.

* * * * *

UNITED STATES PATENT AND TRADEMARK OFFICE

CERTIFICATE OF CORRECTION

PATENT NO. : 8,872,718 B2
APPLICATION NO. : 13/260602
DATED : October 28, 2014
INVENTOR(S) : Christian Desagulier It is certified that error appears in the above-identified patent and that said Letters Patent is hereby corrected as shown below:

In the specification,

Column 4, line 30, please replace "1*a*" with -- I*a* --

Column 4, line 53, please add -- 22 -- between "skin" and "is"

In the claims,

Column 5, line 56, claim 1, please replace "fraction" with -- traction --

Signed and Sealed this
Fourteenth Day of April, 2015

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 8,872,718 B2
APPLICATION NO. : 13/260602
DATED : October 28, 2014
INVENTOR(S) : Christian Desagulier It is certified that error appears in the above-identified patent and that said Letters Patent is hereby corrected as shown below:

In the Claims,

Column 6, please replace "4. An antenna according to claim 1, wherein said elastic material has a Young's modulus of between 0.25 MPa and 1 MPa." with --4. An antenna according to claim 1, wherein said elastic material includes at least one compound belonging to the group of polyimides.--

Signed and Sealed this
Twenty-fifth Day of August, 2015

Michelle K. Lee

Michelle K. Lee
*Director of the United States Patent and Trademark Office*